US005989135A

United States Patent [19]

Welch

[11] Patent Number: 5,989,135

[45] Date of Patent: Nov. 23, 1999

[54] LUMINESCENT GOLF BALL

[75] Inventor: David Emanuel Welch, Wichita, Kans.

[73] Assignee: Night & Day Golf, Inc., Topeka, Kans.

[21] Appl. No.: 09/067,930

[22] Filed: Apr. 28, 1998

Related U.S. Application Data

[60] Provisional application No. 60/045,048, Apr. 28, 1997, provisional application No. 60/079,164, Mar. 24, 1998, and provisional application No. 60/077,370, Mar. 9, 1998.

[51] Int. Cl.[6] ..... A63B 43/06

[52] U.S. Cl. ..... 473/353; 273/DIG. 24

[58] Field of Search ..... 473/353; 273/DIG. 24

[56] References Cited

U.S. PATENT DOCUMENTS

| | | | |
|---|---|---|---|
| 4,613,403 | 9/1986 | Oyachi et al. . | |
| 4,679,795 | 7/1987 | Melvin et al. . | |
| 4,695,055 | 9/1987 | Newcomb et al. . | |
| 4,798,386 | 1/1989 | Berard . | |
| 4,865,326 | 9/1989 | Isaac et al. . | |
| 4,878,674 | 11/1989 | Newcomb et al. . | |
| 4,927,015 | 5/1990 | Jones . | |
| 4,957,297 | 9/1990 | Newcomb . | |
| 5,007,647 | 4/1991 | Gulick . | |
| 5,018,742 | 5/1991 | Isaac et al. . | |
| 5,156,405 | 10/1992 | Kitaoh et al. . | |
| 5,330,195 | 7/1994 | Gulick | 473/353 X |
| 5,427,378 | 6/1995 | Murphy . | |
| 5,494,291 | 2/1996 | Kennedy . | |
| 5,830,087 | 11/1998 | Sullivan et al. | 473/385 |

FOREIGN PATENT DOCUMENTS

| | | |
|---|---|---|
| 59-114158 | 8/1984 | Japan . |
| 59-159459 | 10/1984 | Japan . |

OTHER PUBLICATIONS

Bridgestone, "1985 Golf Gear" Catalog, In Japanese. Translation supplied with comments.

*Primary Examiner*—George J. Marlo
*Attorney, Agent, or Firm*—Robert O. Blinn

[57] ABSTRACT

The golf ball of the present invention has a white core which has a bright, white outer surface and a relatively thin, translucent cover composed of SURLYN® having a thickness of about 0.06 inches or less. The translucent SURLYN® cover contains between 6% and 12% by weight photostorage material, of the type having components such as aluminum oxide, strontium oxide, calcium oxide, europium oxide and boron oxide. A brightly colored fluorescent dye at a concentration between 0.01% and 0.04% by weight can also be added to a SURLYN® cover material to produce a golf ball of the present invention that is brightly colored. When the golf ball of the present invention has no fluorescent dye in its cover, it is substantially white in appearance, is visible in daylight and after being charged by exposure to light, emits a long lasting bright glow of light for high visibility in the dark. When the golf ball of the present invention has an added preferred bright yellow fluorescent dye, it can be seen in daylight and twilight conditions as easily as a standard yellow ball and after being charged by exposure to light also emits a long lasting bright glow of light for high visibility in the dark.

9 Claims, 2 Drawing Sheets

LUMINESCENT GOLF BALL

CROSS REFERENCES TO RELATED APPLICATIONS

This application claims the benefit of U.S. Provisional Patent Application No. 60/045048 filed Apr. 28, 1997, U.S. Provisional Patent Application No. 60/077370 filed Mar. 9, 1998 and U.S. Provisional Patent Application No. 60/079164 filed Mar. 24, 1998.

FIELD OF THE INVENTION

The present invention generally relates to a golf ball and more particularly, this invention relates to a luminescent golf ball which is able to store energy from light and emit light.

BACKGROUND OF THE INVENTION

A conventional golf ball will generally include a flexible solid or wound rubber core enclosed by a relatively hard external cover. The external cover is usually fashioned from Balata or a hard plastic such as SURLYN™ and is white or brightly colored to enhance visibility. The outer surface of the external cover has hundreds of dimples that allow the ball to generate lift as it spins and flies through the air, thereby permitting the well struck golf ball to fly great distances.

A typical golf ball has a diameter near or slightly above 1.68 inches. When well struck by a driver or three wood, a typical golf ball can fly a great distance of over 250 yards. Consequently, it can be difficult to find a golf ball that has been struck a great distance when it does not land in the short turf of the fairway. Many golfers, particularly those drawn from the vast multitude of less skilled golfers, would agree that finding a struck golf ball is an important aspect of the game. The difficulty of finding a struck ball increases very rapidly in the fading light of dusk. Obviously, an ordinary golf ball played at dark would be nearly impossible to find even if it does land in the fairway.

Night golf has become more popular in regions of the United States that have intense heat during the summer. Golf course owners and managers have added lighting to their golf courses to extend play into the evening and allow night play. However, it is expensive and difficult to add extensive lighting to a typical golf course that can stretch for over six thousand yards. A ball that performs well and that emits a bright glow of light could benefit golf course owners and managers who wish to offer night golf by allowing them to do so with much less extensive lighting. Aside from increasing the availability of night golf, golfers could also benefit from a light emitting golf ball in fading light conditions such as at dusk. The golfer who wishes to continue play in the fading light of dusk would prefer a golf ball that emits a bright glow of light for high visibility in low light or dark conditions and that is also highly visible during daylight conditions.

Prior art attempts at a golf ball that emits light include a ball covered by U.S. Pat. No. 4,695,055 by Newcomb. U.S. Pat. No. 4,695,055 by Newcomb discloses a translucent plastic ball having a diametrical bore for receiving a corresponding chemi-luminescent light stick. Newcomb's ball has been relatively successful in the market. Although the Newcomb ball glows very brightly, it has a diametric bore and thus is spherically asymmetrical and therefore does not conform to United States Golf Association (U.S.G.A.) rules. The U.S.G.A. Rules of Golf, Appendix III, requires that a golf ball "must not be designed, manufactured or intentionally modified to have properties which differ from those of a spherically symmetrical ball". Newcomb's ball, aside from the inserted light stick, is essentially one piece, solid polymer ball that suffers from significant performance disadvantages of a one piece, solid ball. Further, because the Newcomb ball is translucent, it takes on the color of its surroundings in daylight or twilight conditions. Accordingly, Newcomb's ball, although a useful night ball, is very difficult to find during the daylight or twilight conditions.

Other earlier attempts to introduce phosphorescent materials or layers of phosphorescent materials into a golf ball have met with little success. The phosphorescent materials employed in these previous attempts have typically been zinc sulfide formulations that have been too weak to emit a sufficiently bright and sustained glow of light to make the ball useful at night. The addition of radioactive promethium to such phosphorescent materials can increase brightness but is accompanied by unacceptable health and environmental hazards. Further, earlier glow-in-the-dark golf balls have had translucent, yellowish green covers which make them very difficult to find during the daytime.

What is needed is a golf ball that performs like a ball which conforms to U.S.G.A. rules, that has an outer appearance that is substantially white or brightly colored so that it is easy to see and find during the day, and which has a cover containing a long lasting high luminescence photostorage material so that it can be easily seen at night. Such a ball would be as easy to see and find as a conventional ball in the day or under artificial night lighting and would also be easy to see and find at dusk or at dark.

SUMMARY OF THE INVENTION

The golf ball of the present invention satisfies the aforementioned need by providing a ball that can be brightly colored in its outer appearance and that can also, when properly charged, emit a sustained, bright glow of light at night. This golf ball performs, in terms of feel and distance much like an ordinary golf ball, is spherically symmetrical and therefore can be adapted to perform in the same manner as an U.S.G.A. approved golf ball.

The golf ball of the present invention, in its most preferred embodiment, has a flexible rubber core having mechanical characteristics similar to cores found in ordinary two piece golf balls. The core of this golf ball, however, is white—either being fashioned from a white rubber or having a white outer coating. The white core is surrounded by a more rigid brightly colored, partially translucent cover that contains a brightly colored florescent dye and a long lasting, high luminescence photostorage material. The resulting cover is brightly colored, yet partially translucent. The florescent dye used in the cover of the most preferred embodiment is bright yellow. Such a yellow florescent dye is highly visible in daylight conditions and is most compatible with the yellowish green light emitted by the long lasting, high luminescence photostorage material also present in the cover. Because the present golf ball in its most preferred embodiment has a thin, partially translucent cover and a white core, under bright light, such as daylight, it appears brightly colored. Because of the presence of high luminescence long lasting photostorage material in its cover, the golf ball of the present invention, when properly charged by exposure to light, also emits a long lasting, bright glow of light for high visibility at night or low light conditions.

Accordingly, the golf ball of the present invention satisfies the aforementioned need by providing a high performance, spherically symmetrical golf ball that is easy to see and find during daytime or twilight play and that is also easy to see and find during play at night or during low light conditions.

BRIEF DESCRIPTION OF THE DRAWINGS

The following detailed description refers to the attached drawings in which.

DETAILED DESCRIPTION OF THE INVENTION

Figure 1:
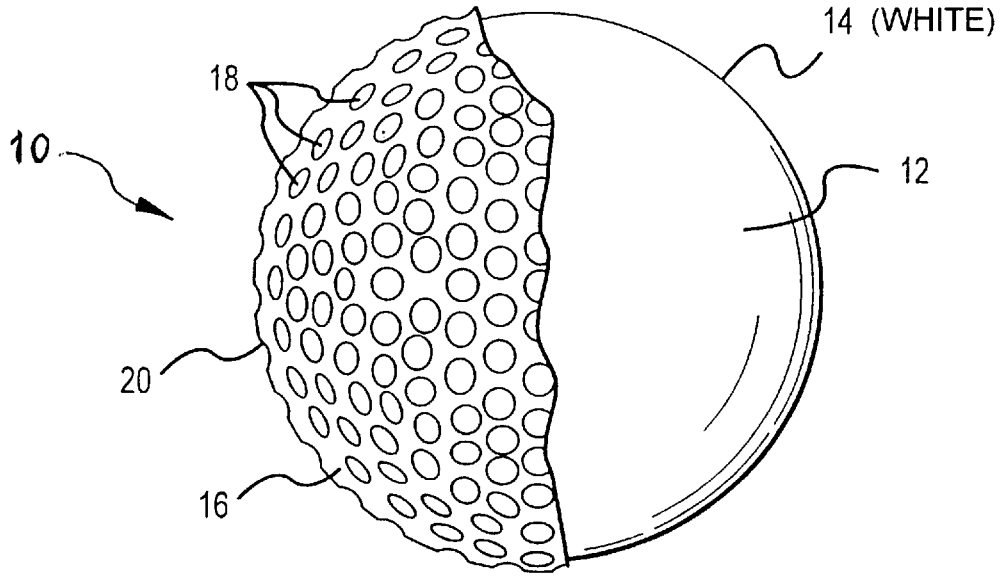
FIG. 1 is a partially cut away view of the golf ball of the present invention.

Referring to FIG. 1 there is illustrated a luminescent golf ball 10 of the present invention. Golf ball 10 includes a core 12 and a cover 16. The core 12 also has a core surface 14 and the cover 16 also has an uniformly dimpled cover surface 18. A standard clear coat 20 covers the outer surface of golf ball 10.

As shown in FIG. 1, core 12 is spherical and made from, flexible rubber having mechanical properties substantially similar to rubber cores found in ordinary golf balls. Core surface 14 should be light reflective having a light colored appearance and preferably should be smooth and white. Alternatively, core 12 can be made from a darker rubber material if the core surface 14 is given a light reflective, light colored or white coating. In order for golf ball 10 to conform to U.S.G.A. rules, core 12 must be of sufficient diameter so that when its diameter is added to twice the thickness of cover 16, the resulting total diameter is not less than the U.S.G.A. minimum 1.68 inches or 42.67 mm. Also, in order for golf ball 10 to perform like an U.S.G.A. approved golf ball, core 12 must be adapted so that when combined with cover 16, the resulting golf ball does not exceed a maximum weight of 1.62 oz or 45.93 grams and does not exceed U.S.G.A distance standards when mechanically struck during an U.S.G.A. approved test.

Figure 2:
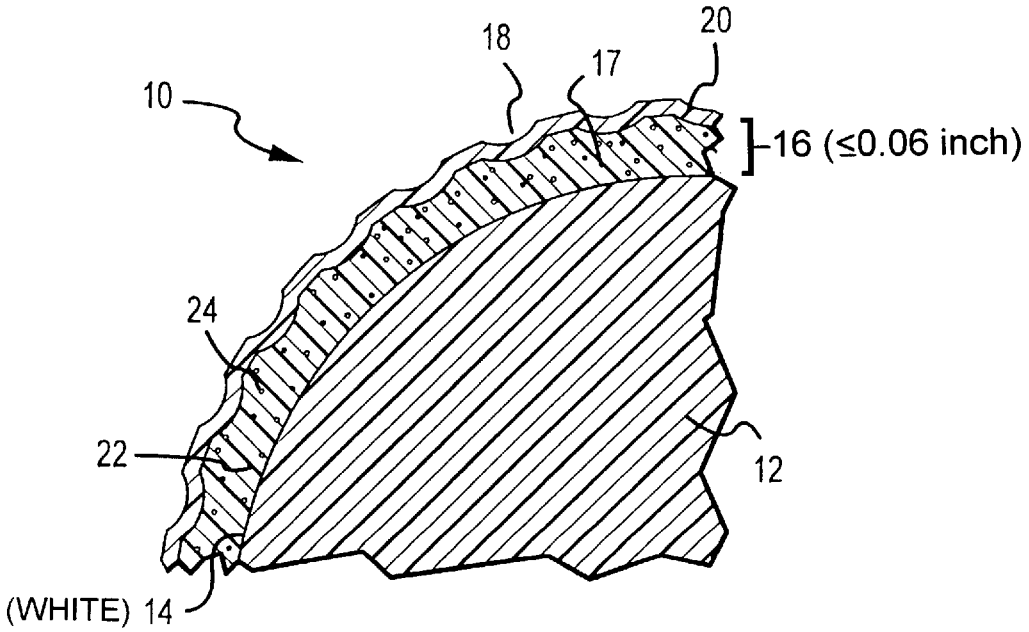
FIG. 2 is a magnified view of the periphery of the golf ball of FIG. 1.

Cover 16 shown in FIG. 1, is preferably fashioned from substantially translucent semi-rigid plastic material having mechanical properties substantially similar to ordinary two piece golf ball cover materials. Preferably, cover 16 should have a thickness at or below 0.06 inches. As further shown in FIG. 2, cover 16 is fashioned from a translucent SURLYN material 17 mixed with a photostorage material 22. Photostorage material 22 is preferably a long lasting photostorage material such as Chemitech Picariko CP-05 photostorage material or PERMAGLOW™ photostorage material . Chemitech Picariko CP-05 or PERMAGLOW™ photostorage material is a photostorage material comprised of Aluminum Oxide, Strontium Oxide, Calcium Oxide, Europium Oxide and Boron Oxide. It can be obtained from the Chemitech Inc. of Tokyo, Japan. Photostorage material 22 can also be a suitable long lasting photostorage material of the same general class as is described and claimed in U.S. Pat. No. 5,424,006 and 5,686,022 issued to Marayama, et. al. This material can be obtained from Nemoto & Co., Ltd. of Tokyo, Japan.

Photostorage material 22 as described above can be added to normally translucent substantially pure SURLYN™ during the manufacture of a golf ball in much the same way that commonly used colorants are added to SURLYN™ to produce white or brightly colored golf ball covers. A SURLYN™ mixture having 10% by weight of photostorage material at the end of a conventional golf ball manufacturing process results in a golf ball cover that is yellowish green in color, substantially translucent and glows brightly after being exposed to light having an UV component. SURLYN™ mixtures having concentrations of photostorage material substantially above 10% are difficult and expensive to produce due to presence of larger amounts of the relatively expensive photostorage material.

Further, such high concentration mixtures do not produce significantly more light when excited. On the other hand, SURLYN™ mixtures containing much less than 10% by weight of a photostorage material emit less light and are therefore unsuitable. Accordingly, a SURLYN mixture having a concentration of photostorage material between 5% and 14% by weight is suitable while a SURLYN mixture containing a concentration of photostorage material between 8% and 12% is optimum in terms of ball performance, cost and light emission.

When the resulting above described mixture of SURLYN™ and photostorage material is formed in a ball cover such as cover 16 having a thickness near or slightly below 0.06 inches, it is slightly cloudy and substantially translucent. Because of the relatively high preferred concentration of the photostorage material 22 of approximately 10% by weight in cover 16, the thickness of cover 16 can be held near or slightly under 0.06 inches and still be able to absorb and emit a substantial amount of light. Further, because cover 16 is thin, less of the light emitted from the photostorage material 22 is trapped and therefore more of it escapes. Still further, since cover 16 is thin, golf ball 10 appears substantially white but slightly yellowish green. The smooth, white core surface 14 tends to reflect light emitted by cover 16 out and away from core surface 14. Although cover 16 is relatively thin, it has an adequately dimpled surface 18 which will impart well known advantages to the performance of golf ball 10. If no other materials are added to golf ball cover 16, the resulting golf ball will appear substantially white but slightly yellowish green.

If golf ball 10 of the present invention is left substantially white, but slightly yellowish green as described above, golf ball 10 could be somewhat difficult to find in daylight conditions. A luminescent golf ball having a standard yellow pigment in its cover could be easily seen during the daytime, however, the yellow pigment would block escaping light so that the ball would glow less brightly after being exposed to light. It therefore seemed that any attempt to color a ball for easy daytime visibility would be done at the cost of diminished night time brightness. The applicant has found, however, that a small amount of florescent dye, and particularly yellow florescent dye can be added to cover 16 to produce a bright yellow ball that is easy to see and find in daylight conditions and that actually appears to glow more brightly than a ball having no florescent dye.

Accordingly, in its most preferred embodiment, a bright, transparent, florescent dye 24 is added to the SURLYN™ material of cover 16 of golf ball 10 at a final concentration of less than 0.04% by weight in addition to the photostorage material 22 described above. A florescent dye such as florescent dye 24 can be obtained from M. A. Hanna Inc. of Suwanee, Georgia under the tradename of Edgeglow™ colorant. In order to add highly concentrated florescent dye 24 to the SURLYN™ material of cover 16, it is best to first produce SURLYN pellets having an intermediate concentration of dye at for example 0.5% by weight. When SURLYN pellets having such an intermediate concentration of 0.5% dye by weight are combined with other SURLYN™ containing no dye at the rate of 6 parts per hundred or 6%, the resulting SURLYN™ mixture has a final dye concentration of 0.03%. Preferably, florescent dye 24 should be a yellow florescent dye so that the resulting golf ball not only emits a bright glow of light after exposure to light, it has a bright yellow appearance under daylight conditions. With the additional yellow florescent dye 24, cover 16 is bright yellow but still partially translucent. Although any easily visible bright colored dye can be employed, a yellow florescent dye is most preferred because its color is compatible with the yellowish green light emitted by the photostorage material 22.

When yellow florescent dye 24 is added to the SURLYN™ material of cover 16, the resulting golf ball is brightly yellow much like an ordinary bright yellow golf ball. Although cover 16, with added florescent dye is partially translucent, cover 16 surrounds a white core surface 14. The combination of brightly yellow, partially translucent cover 16 and core 12 having white core surface 14 yields golf ball 10 which appears to be bright yellow and which can be easily seen and found during the day. Because cover 16 contains a relatively high concentration of a long lasting, high luminescence photostorage material 22 as described above, and especially because cover 16 can contain a yellow florescent dye having a color compatible with the yellowish green light emitted by the photostorage material 22, resulting golf ball 10 emits a bright glow of light when properly charged and therefore can be seen easily during night conditions.

It is important that in the most preferred embodiment, a florescent dye is used in cover 16 as opposed to a standard pigments commonly used in golf ball covers. This is true for two reasons. First, standard pigments commonly used in golf ball covers are more granular and therefore opaque. Florescent dyes have much smaller particle sizes that are typically on a molecular scale and therefore can be used to formulate translucent or partially translucent materials. Secondly, the applicant has discovered that preferred yellow florescent dye 24 works in concert with photostorage material 22 by reacting to emissions from photostorage material 22 and even reacting to emissions from photostorage material 22 outside the visible spectrum and fluorescing to emit yellow, visible light. The applicant has observed that where two golf balls having covers with equal concentrations of photostorage material 22 and differing concentrations of yellow florescent dye 24, the ball having the higher concentration of yellow florescent dye 24 will glow more brightly after equal exposure to light having a substantial ultra violet component. More particularly, the applicant has observed that where two golf balls have covers with equal 10% by weight concentrations of photostorage material 22 as described above and 0.02% and 0.01% by weight concentrations of florescent yellow dye 24 respectively, the ball having the greater, 0.02% concentration of yellow florescent dye 24 glows more brightly after equal charging than the ball having the lesser 0.01% concentration of florescent yellow dye 24. The applicant has found that a ball having a cover with more than 0.01% florescent yellow dye and less than 0.04% yellow florescent dye 24 is an acceptably bright yellow ball that can be found during the daytime. Still further, core 12 could also include standard yellow or yellowish green pigments or colorants and still reflect yellowish green light emitted by the photostorage material 22 in cover 16 while enhancing the yellow appearance of golf ball 10. Cover 16 could also include small amounts of a standard colorant without significantly reducing its light emitting performance.

Accordingly, in its most preferred embodiment, golf ball 10 of the present invention has a core 12 with a white outer surface 14, a SURLYN cover 16 having a multitude of dimples 18, cover 16 containing yellow florescent dye 24 at a concentration of more than 0.01% and less than 0.04% by weight and also containing long lasting, high luminescence photostorage material 22 at a concentration of no less than 6% and no more than 12% by weight. Golf ball 10 when having a white core such as core 12 and a cover such as cover 16 is easy to see during the day and when properly charged by exposure to bright light, emits a bright glow of light for easy visibility during low light or dark conditions.

Golf ball 10 of the present invention can be used during the daytime much as any golf ball would be used as known by any skilled reader. During night conditions, a compact florescent light that emits in the ultra violet end of the spectrum can be used to charge golf ball 10. Prior to placing golf ball on a tee at night, the user should charge golf ball 10 by shining such a compact florescent light on the surface of golf ball 10 for about ten seconds. The photostorage material 22 in cover 16 will absorb and store radiant energy from the compact florescent light. Thus charged, golf ball 10 and more particularly cover 16 of golf ball 10 will emit a bright yellow-green glow. Golf ball 10 can then be placed on a tee and struck much like any golf ball. The golfer after striking golf ball 10 can find golf ball 10 even in the dark. If a second shot is needed, the golfer can play the still brightly glowing golf ball 10 or even recharge golf ball 10 to maximum brightness with the portable florescent light as it lies on the golf course. In this manner a golfer may use golf ball 10 in dark conditions. If cover 16 of golf ball 10 also includes a yellow or brightly colored florescent dye as described above, then golf ball 10 can be played in fading twilight conditions as the golfer gradually begins charging the ball as described above to accomplish a smooth transition to night play.

Figure 3:
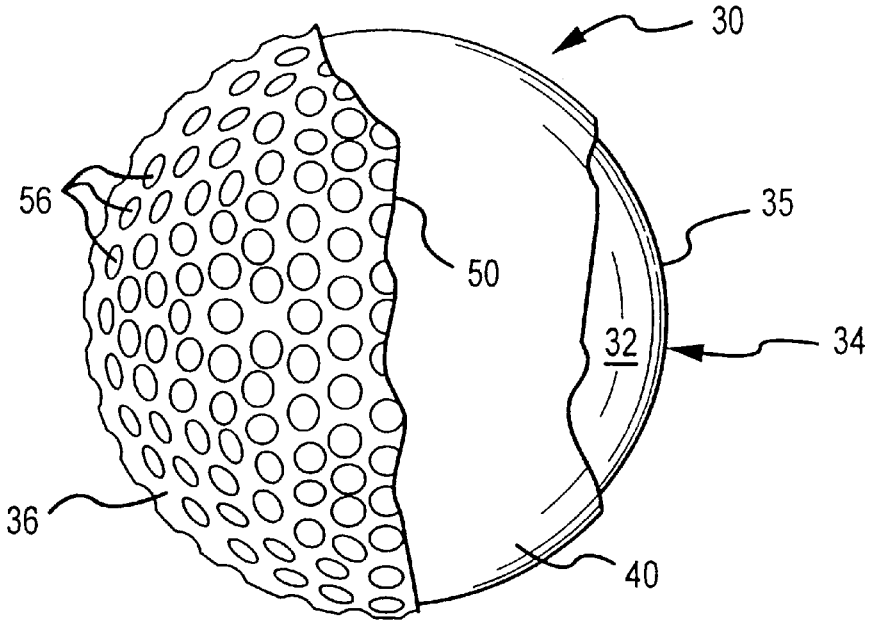
FIG. 3 is a partially cut away view of a second golf ball which is a second embodiment of the present invention.
Figure 4:
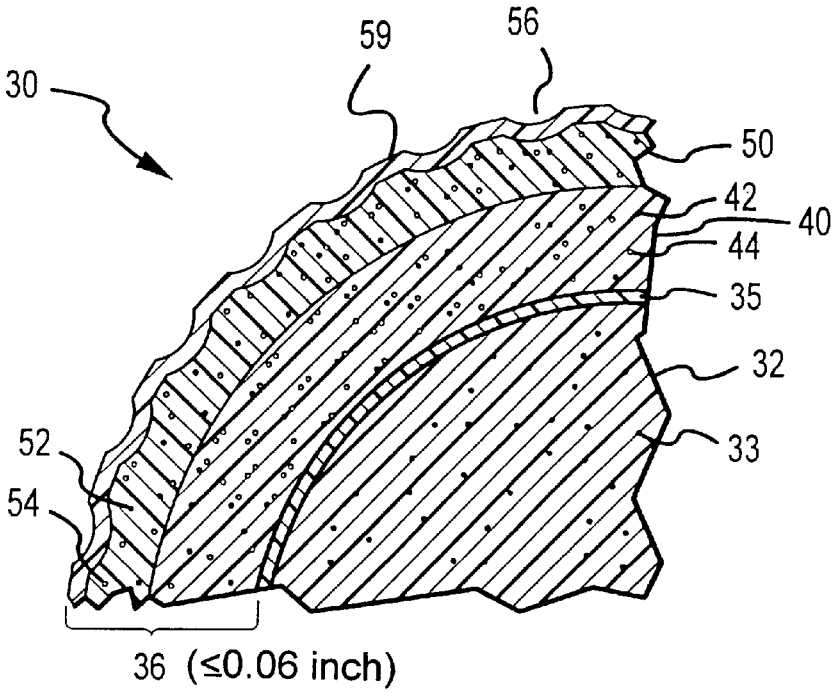
FIG. 4 is a magnified view of the periphery of the golf ball of FIG. 3.

FIG. 3 and FIG. 4 illustrate a second golf ball 30 having a core 32 pigmented with colorant 33, and a cover 36. Core 32 also includes a core surface 34 which can includes a core coating 35. Cover 36 further includes an first cover layer 40 and a second cover layer 50. First cover layer 40 includes a photostorage material 42 at a first photostorage material concentration and a phosphorescent dye 44 at a first dye concentration. Second cover layer 50 includes photostorage material 52 at a second photostorage material concentration and a phosphorescent dye 54 at a second dye concentration of as well as a multitude of dimples 56 in its outer surface and a clear coating 59 about its outer surface.

Golf ball 30 as shown in FIG. 3 and FIG. 4 can be adapted so that first photostorage material concentration of photostorage material 42 in first cover layer 40 can be much different than second photostorage material concentration of photostorage material 52 in second cover layer 50. Similarly, Golf ball 30 as shown in FIG. 4 can be adapted so that first dye concentration of phosphorescent dye 44 in first cover layer 40 can be much different than second dye concentration of phosphorescent dye 54 in second cover layer 50. Still further, both or either dye or photostorage material can be added to clear coat 58 as well as core coating 35. The flexible configuration of golf ball 30 as shown if FIG. 4, although more complex and perhaps more expensive to manufacture, provides a way to optimize color and luminescent properties by manipulating the concentrations of dye and photostorage material in the various layers. For example, core coating 35 could contain a high concentration of dye or pigment to give golf ball 30 a brightly colored appearance. For example, the first dye concentration of phosphorescent dye 44 in first cover layer 40 can be much higher than the second dye concentration of phosphorescent dye 54 in second cover layer 50 while the photostorage material concentration of photostorage material 42 in first cover layer 40 can also be much higher than the second photostorage material concentration of photostorage material 52 in second cover layer 50. Any combination of concentrations of dye and photostorage material can be used as long as the total average concentration of dye or photostorage material is maintained within or near the above described optimal limits of 0.01% to 0.04% by weight for a phosphorescent dye and 6% to 12% by weight for photostorage material.

The skilled reader, in view of this specification may envision numerous modifications and variations of the above disclosed preferred embodiment. Accordingly, the reader should understand that these modifications and variations, and the equivalents thereof, are within the spirit and scope of this invention as defined by this specification and by the following claims wherein, I claim:

1. A luminescent golf ball comprising:

a flexible core having a light reflective substantially white outer surface, a thin cover surrounding the core having a thickness of substantially no more 0.06 inches, the cover also containing photostorage material at a concentration of no less than 3% and no more than 16% by weight for absorbing radiant energy and emitting a glow of light, the photostorage material in the golf ball cover storing radiant energy and re-emitting a glow of light, the substantially white core also reflecting the glow of light away from the golf ball, the thin cover allowing the light to escape from the golf ball, the thin cover also allowing the white cover to show through the cover during bright daylight conditions, whereby the golf ball glows brightly in dark conditions and therefore is easily seen on a golf course at twilight or at dark and whereby the golf ball appears substantially white during bright daylight conditions and is therefore visible on a golf course in bright, daylight conditions.

2. The luminescent golf ball of claim 1, wherein the cover contains photostorage material at a concentration of no less than 4% and no more than 12% by weight.

3. The luminescent golf ball of claim 1, wherein, the cover is also coated with a clear coat and the clear coat further includes a brightly colored florescent dye whereby the golf ball has a brightly colored appearance and whereby the brightly colored florescent dye cooperates with the photostorage material when the photostorage material is emitting light to fluoresce and also emit light and whereby the brightly colored florescent dye imparts a brightly colored appearance to the golf ball for higher visibility during daylight conditions.

4. A brightly colored luminescent golf ball comprising:

a flexible core having a light reflective substantially white outer surface, a translucent cover surrounding the flexible core, the partially translucent cover including photostorage material for absorbing light and later emitting a glow of light, the partially translucent cover also including a brightly colored fluorescent dye, the dye in the cover and the light reflective core cooperating to impart a brightly colored appearance to the golf ball whereby the golf ball is brightly colored so that the golf ball can be easily seen and found in daylight conditions upon a golf course, the photostorage material in the golf ball cover also storing light energy and emitting a glow of light, the substantially white core also reflecting the glow of light away from the golf ball, whereby the golf ball glows brightly in the dark so that the golf ball can also be easily seen and found on a golf course at twilight or in the dark.

5. The brightly colored luminescent golf ball of claim 4, wherein, the concentration of brightly colored fluorescent dye in the translucent cover material is no less than 0.01% by weight and no more than 0.10% by weight and the concentration of a photostorage material in the translucent cover material is no less than 3% by weight and no more than 16% by weight.

6. The brightly colored luminescent golf ball of claim 4, wherein a the translucent cover is coated with a clear coat coating containing a fluorescent dye.

7. A brightly colored luminescent golf ball comprising:

a flexible rubber core having a substantially white outer surface, a partially translucent cover surrounding the rubber core, the partially translucent cover further comprising at least two layers, at least one of the at least two layers of the partially translucent cover having a concentration of photostorage material and at least one of the at least two layers of the partially translucent cover having a concentration of brightly colored dye whereby the average concentration of the photostorage material throughout the at least two layers of the partially translucent cover is more than 3% by weight and less than 16% by weight and the average concentration of the brightly colored dye throughout the at least two layers of the partially translucent cover is more than 0.01% by weight and less than 0.1% by weight, the brightly colored dye in the at least one of the at least two layers of the golf ball cover and the substantially white outer surface of the core cooperating to impart a brightly colored appearance to the golf ball whereby the golf ball is brightly colored and can be easily seen and found in daylight conditions on a golf course, the photostorage material in the golf ball cover also absorbing radiant energy and re-emitting a glow of light, the substantially white core also reflecting the glow of light away from the golf ball, whereby the golf ball glows brightly in dark conditions and therefore is also easily seen and found at twilight or in the dark on a golf course.

8. The brightly colored luminescent golf ball of claim 7, wherein the average concentration of the photostorage material in the cover is between 6% and 12% by weight and wherein the brightly colored dye in the cover is a florescent dye and the average concentration of florescent dye is between 0.01% and 0.04% by weight.

9. The brightly colored luminescent golf ball of claim 7, wherein the translucent cover is coated with a clear coat containing a fluorescent dye.

* * * * *